US008997757B1

(12) United States Patent
Soare

(10) Patent No.: US 8,997,757 B1
(45) Date of Patent: Apr. 7, 2015

(54) GOLDEN RATIO EYEBROW SHAPING METHOD

(71) Applicant: Anastasia Soare, Beverly Hills, CA (US)

(72) Inventor: Anastasia Soare, Beverly Hills, CA (US)

( * ) Notice: Subject to any disclaimer, the term of this patent is extended or adjusted under 35 U.S.C. 154(b) by 0 days.

(21) Appl. No.: 14/054,675

(22) Filed: Oct. 15, 2013

(51) Int. Cl.
*A45D 7/00* (2006.01)
*A45D 40/30* (2006.01)
*A45D 44/00* (2006.01)

(52) U.S. Cl.
CPC ..... *A45D 44/00* (2013.01)

(58) Field of Classification Search
CPC ..... A45D 43/30; A45D 44/00
USPC ..... 132/200, 216, 320
See application file for complete search history.

(56) References Cited

U.S. PATENT DOCUMENTS

| | | | |
|---|---|---|---|
| 2,435,516 | A | 2/1948 | Samson |
| 4,118,870 | A | 10/1978 | Dyson |
| 7,219,674 | B1 | 5/2007 | Shelley |
| 8,015,981 | B2 | 9/2011 | Soare |
| 8,342,190 | B2 | 1/2013 | Soare |
| 8,505,552 | B1 | 8/2013 | Soare |
| 8,763,614 | B2 | 7/2014 | Soare |
| 2006/0249173 | A1 | 11/2006 | Lawson |
| 2007/0006748 | A1 | 1/2007 | Liu |
| 2009/0151741 | A1 | 6/2009 | Ngo |
| 2010/0229886 | A1 | 9/2010 | Plain |
| 2011/0135205 | A1 | 6/2011 | Rhee |
| 2013/0098385 | A1 | 4/2013 | Soare |
| 2013/0306091 | A1 | 11/2013 | Soare |

OTHER PUBLICATIONS

ABC Brow Mapping Technique [date unknown; believed to be after the effective date of the application].
Spirit Custom Makeup, Blog Archive; 2010: The Year of the Browl, http://www.spiritcustommakeup.com/blog/?p=29; pp. 1-2, printed Apr. 11, 2014.
FLARE Eyebrow 101, May 12, 2008, http://www.flare.com/beauty.brow-101/; pp. 1-4, printed Apr. 11, 2014.
High Brow: Your guide to perfect eyebrows—Minneapolis Spa Treatments, examiner.com, http://www.examiner.com/article/high-brow-your-guide-to-perfect-eyebrows, pp. 1-4, printed Apr. 11, 2014.
How to Shape the Perfect Eyebrow, How to Create the Perfect Eyebrow, Behind the Scenes Makeup, http://www.behindthescenesmakeup.com/beauty-tips-tricks/how-to-shape-the-perfect-eyebrow/, pp. 1-7, Apr. 11, 2014.
Jessica Allison, beauty practices, products and philosophy: Eye Brow 101: The Ideal Shape, Wednesday, Dec. 9, 2009, http://outinapout.blogspot.com/2009/12/perfect-brow-is-bit-like-comfortable.html, pp. 1-4, printed Apr. 11, 2014.
Cameron Tuttle, Raising Eyebrows; your personal guide to fabulous brows: Part 4 Esthetics, Chapter 17 Hair Removal, Mar. 2012, pp. 418-419, ISBN 9781452111339, ISBN 101452111332, http://www.chronicklebooks.com/titles/raising-eyebrows.html, pp. 1-3, printed Aug. 21, 2014.
Anastasia Beverly Hills, Golden Ratio®, http://www.anastasia.net/golden-ratio.html, pp. 1-2, printed Jun. 12, 2014.
PCT International Search Report and Written Opinion of the U.S. International Searching Authority, completed on Nov. 5, 2014 and mailed on Dec. 18, 2014.

*Primary Examiner* — Rachel Steitz
(74) *Attorney, Agent, or Firm* — Greenberg Traurig, LLP

(57) ABSTRACT

An eyebrow shaping method includes providing an image of a face. Three guidelines are determined on the image and thee points are located via the guidelines. An eyebrow is shaped to have Golden Ration proportions via the three points.

2 Claims, 4 Drawing Sheets

GOLDEN RATIO EYEBROW SHAPING METHOD

CROSS REFERENCE TO RELATED APPLICATIONS

This application is related to U.S. Pat. No. 8,015,981, issued on Sep. 13, 2011, entitled Stencils and Gauging Device for Aesthetically Pleasing Eyebrow shaping, and U.S. Pat. No. 8,505,552 issued on Aug. 13, 2013, entitled Golden Ratio Eyebrow Overlay Device, the content of which are hereby incorporated by reference in their entirety.

BACKGROUND OF THE DISCLOSURE

This disclosure relates to cosmetic materials, and in particular to eyebrow shaping techniques and related devices. The Golden Ratio is often denoted by the Greek letter $\phi$ ('phi'). It expresses a relationship that the sum of two quantities is to the larger quantity as the larger is to the smaller (its numerical approximation is 1.618033989). The Golden Ratio is a proportion universally found in Nature, expressed in the arrangement of branches along the stems of plants, in the placement of the shell spirals in snails, or in the features of the human body. The Golden Ratio is widely believed to be a natural principle related to the laws of equilibrium. Many great artists have proportioned their works according to the Golden Ratio, as it is believed to be aesthetically pleasing. Hence, a "perfect" face would display Golden Ratio proportions such as these: Distance from Top-of-the-head to Chin divided by Width-of-head equals $\phi$; Length-of-Lips divided by Width-of-Nose equals $\phi$; Outside distance between Eyes divided by Length-of-Lips equals $\phi$; etc. It follows that, on a "perfect" face, the high point (HP) of the eyebrow would divide the eyebrow arch at precisely the Golden Ratio point between the starting point of the eyebrow (SP) and the ending point of the eyebrow (EP) (SP-HP divided by HP-EP=$\phi$).

SUMMARY OF THE DISCLOSURE

One method in accordance with the present disclosure includes providing a frontal image of a person's face including the tip of the person's nose, nostrils, eyes including irises, supraorbital margins, and eyebrows. Three guide lines are determined on the image. The first guide line extends from the tip of the nose through an iris at the center of an eye. The second guide line extends vertically through the center of a nostril. The third guide line extends from the outer edge of the nostril through the outer edge of the respective eye. As used herein, "respective" means on the same side of the face as (e.g., the right eye is the respective eye to the right nostril). Three points are located on the image. The first point is located on the first guide line one iris diameter upward from the intersection of an upper edge of the iris and the first guide line. The second point is located at the intersection of a respective supraorbital margin and the second guide line. The third point is located at the intersection of the supraorbital margin and the third guide line. The eyebrow is then shaped such that: a concave underside of a high point of the eyebrow is located at the first point; a starting point of the eyebrow is located at the second point; and an ending point of the eyebrow is located at the third point.

Another method in accordance with present disclosure includes providing a plurality of eyebrow templates, then positioning, one by one, each eyebrow template of the plurality of eyebrow templates such that the concave underside of the high point of the eyebrow template aligns with the first point. For each eyebrow template, a first offset from the starting point of the eyebrow template to the second point is determined. A second offset from the ending point of the eyebrow template to the third point is also determined for each template. Then the eyebrow template having the smallest total offset is selected and the person's eyebrow is shaped according to the selected template.

The methods in accordance with the present disclosure enable even a relatively unskilled beautician to quickly and accurately determine the most flattering, ideal shape of the eyebrow for any given customer according to the Golden Ratio standard.

Further features, advantages and characteristics of the embodiments of this disclosure will be apparent from reading the following detailed description when taken in conjunction with the drawing figures.

DETAILED DESCRIPTION

When the eyebrow high point (HP) is located on an first guide line 1 extending from the center of the nose through the iris at the center of the eye, the starting point (SP) of a person's eyebrow is on a second guide line 2 running vertically through the middle of the respective nostril, and the end point of that eyebrow (EP) is on a second guide line 3 running from the outer edge of the nostril through the outside end of the respective eye, there is an optimal match between the eyebrows and the other facial features. Although such a placement of the high point (HP) will typically be at the Golden Ratio only for a "perfect" face, such an eyebrow placement will also result in an aesthetically pleasing adjustment to a person's face when facial proportions are less than "perfect". The methods in accordance with the present disclosure, illustrated in FIGS. 1-7 utilize these guide lines to facilitate shaping of the eyebrows.

Figure 1:
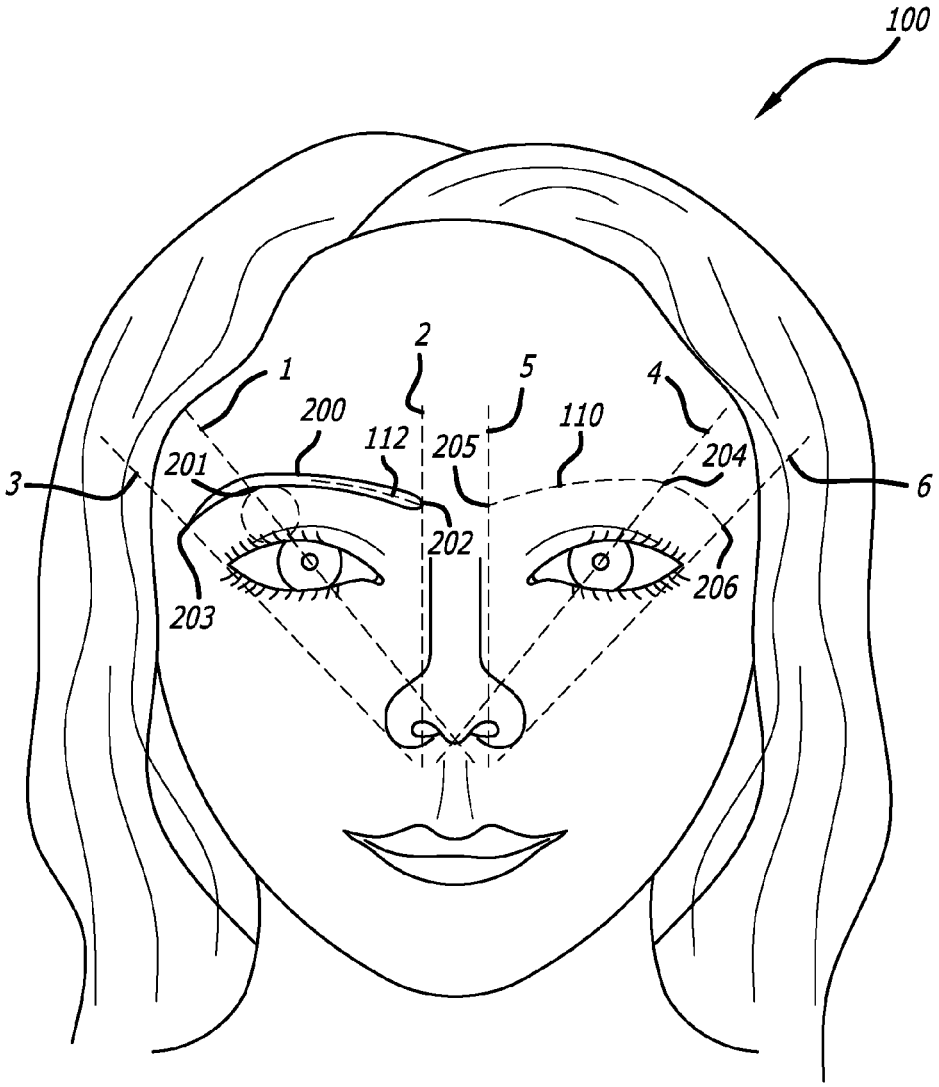
FIG. 1 is full-face frontal image of a person's face including various guide lines in accordance with the present disclosure.

Methods in accordance with the present disclosure enable even a relatively unskilled person to quickly and accurately determine the location and shape of her eyebrows according to the Golden Ratio standard. One exemplary method of the present disclosure is illustrated in FIG. 1. The image 100 of the person's face may be a reflection in a mirror or it may be a displayed photographic image of the person's face on a display device such as on a laptop display, desktop computer display, tablet computer or cell phone screen. In a preferred embodiment, the image of the person's face is a full-face frontal view (i.e., taken at an angle of 0 degrees relative to the face). In another embodiment, the image may show only a portion of the face. In other embodiments, the image may be taken from one side of the face at an angle of not greater than 45 degrees relative to the face, or more preferably at an angle of not greater than 20 degrees relative to the face, or more preferably at an angle of not greater than 10 degrees relative to the face.

As shown in FIG. 1, a person's right eyebrow 200 is shaped according to three guide lines 1, 2, 3. The eyebrow 200 has a high point (HP). As used herein, "eyebrow high point (HP)" means the highest point on the arch of an eyebrow. The lower edge of the eyebrow at the high point is the concave underside of the high point. The concave underside of the high point of the right eyebrow 200 is located on a first guide line 1, at a first point 201 that is one iris diameter upward from the intersection of the first guide line 1 and the upper edge of the iris of the right eye. As used herein, "iris diameter" means the diameter of a person's iris in an image of the person's face, measured for example, in millimeters. The starting point (SP) of the right eyebrow 200 is located at a second point 202 at the intersection of a second guide line 2 and the right supraorbital margin 112. As used herein the starting point (SP) of an eyebrow means the inner end of the eyebrow (i.e., the end closest to the bridge of the nose). As used herein, "supraorbital margin" means the upper half of the rim of a bony cavity in a skull, such bony cavity normally containing an eyeball. The ending point (EP) of the right eyebrow 200 is located at a third point 203 at the intersection of a third guide line 3 and the respective supraorbital margin 112. As used herein the ending point (EP) of an eyebrow means the outer end of the eyebrow (i.e., the end furthest from the bridge of the nose).

The first guide line 1 is determined by extending a line from the tip of the nose through the center of the iris of the right eye. The second guide line 2 is determined by extending a line vertically from the center of the right nostril. The third guide line 3 is determined by extending a line from the outer edge of the right nostril through the outer edge of the respective eye.

The left eyebrow (not pictured) is similarly shaped according to three guidelines 4, 5, 6. The concave underside of the high point of the left eyebrow is located on a fourth guide line 4, at a fourth point 204 that is one iris diameter upwards from the intersection of the fourth guide line 4 and the upper edge of the respective iris. The starting point (SP) of the left eyebrow is located at a fifth point 205 at the intersection of a fifth guide line 5 and the respective supraorbital margin 110. The ending point (EP) of the left eyebrow is located at a sixth point 206 at the intersection of a sixth guide line 6 and the respective supraorbital margin 110.

The guide lines for the left eyebrow are determined in a similar manner to the guide lines for the right eyebrow. The fourth guide line 4 is determined by extending a line from the tip of the nose through the center of the iris of the left eye. The fifth guide line 5 is determined by extending a line vertically from the center of the left nostril. The sixth guide line 6 is determined by extending a line from the outer edge of the left nostril through the outer edge of the respective eye.

Once the locations of the eyebrow high point, starting point, and ending point, have been determined it remains to manipulate the final contours of the eyebrow into a pleasing eyebrow shape. In one method, the step of contouring the eyebrow based on the located points may be completed in a free form manner. In another method, a set of various eyebrow shapes, each one having a high point located at the Golden Ratio point (i.e., SP-HP divided by HP-EP=$\phi$), can be used to facilitate shaping a person's eyebrows. Utilization of a set of eyebrow shape templates permits even a relatively unskilled person to quickly choose the most flattering, ideal shape of the eyebrows for the particular customer's face according to the Golden Ratio standard.

Figure 2:
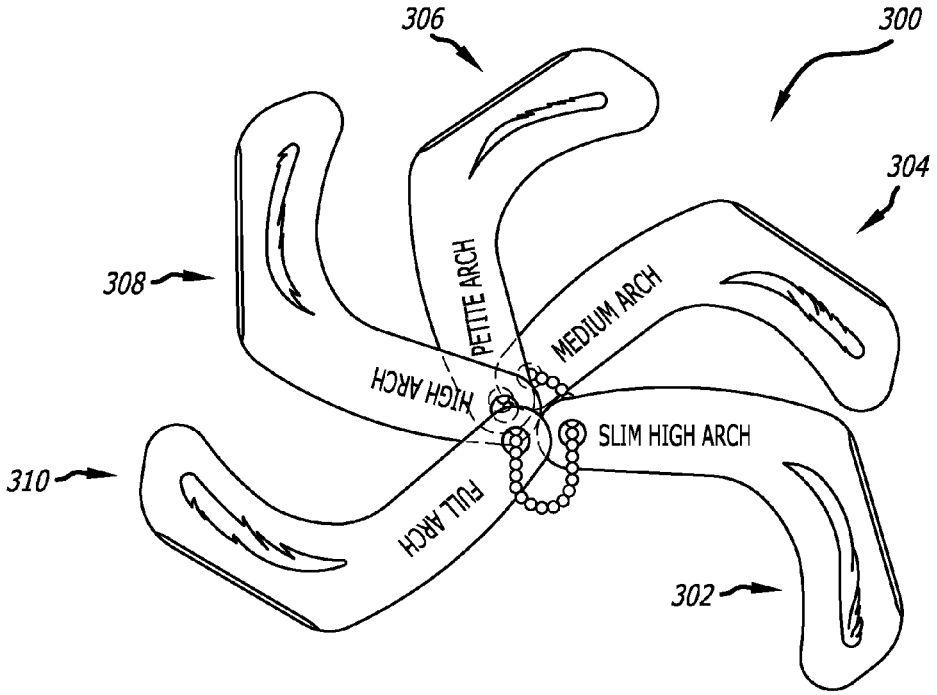
FIG. 2 is an assembled front expanded perspective view of a device that may be used in accordance with the present disclosure, the device consisting of a set of the templates in accordance with the disclosure fastened together by a chain.

An exemplary set of eyebrow shape templates 300 including five separate templates 302, 304, 306, 308 and 310 fastened together by a chain 312 is shown in FIG. 2. Each template 302, 304, 306, 308 and 310 is separately shown in FIG. 3.

Figure 3:
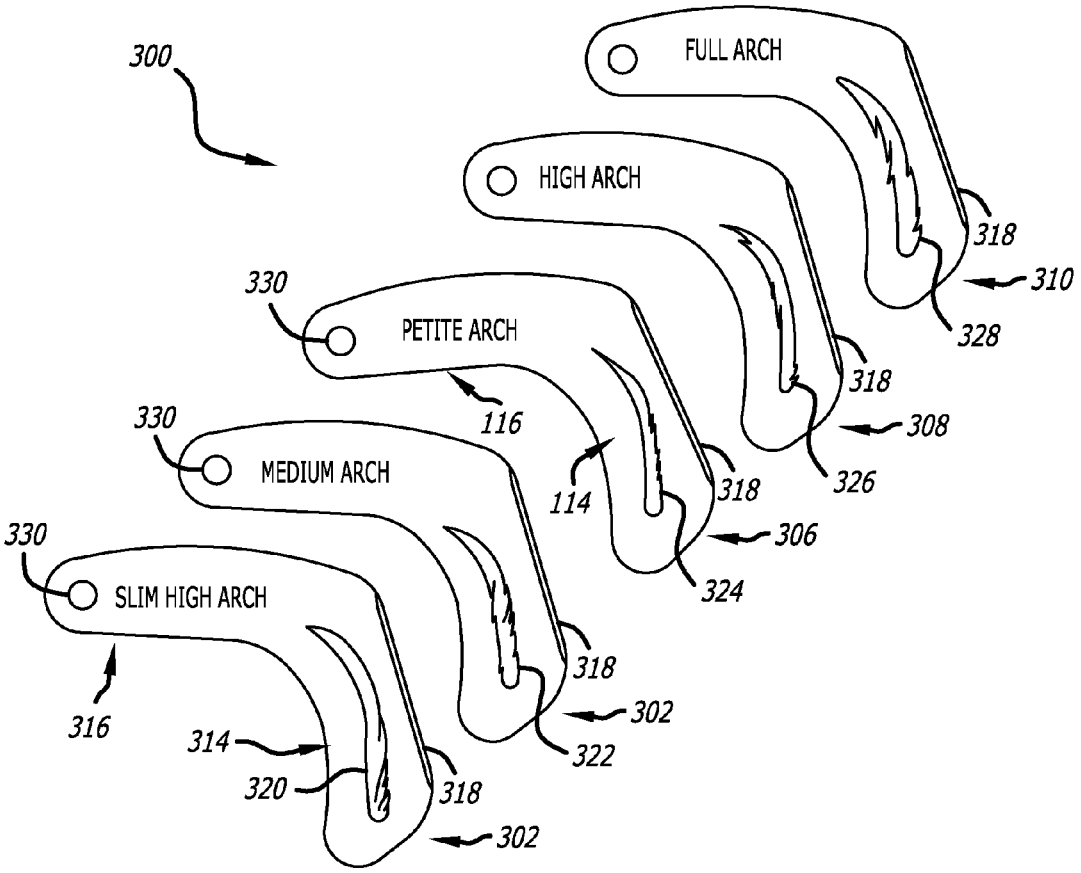
FIG. 3 is a separate front view of each template in the device shown in FIG. 2.

Referring now to FIG. 3, each template is identical except for the eyebrow shape printed on the template. Each of these templates 302-310 has an arched or arcuate shape made from a stiff flexible transparent sheet plastic material. Each template 302-310 has an eyebrow template portion 314 curving into a handle portion 316. The eyebrow template portion has a straight upper edge 318 that should be oriented horizontally when the template is grasped by the handle portion and held up to a customer's face with the eyebrow portion superimposed in front of the customer's eyebrow.

The curved handle portion 316 is angled downward similar to that of an eyeglass lorgnette so that a user can position the eyebrow portion properly without touching the customer's nose. Each curved handle portion 316 has an aperture 330 adjacent the distal end for receiving the chain 312 when the device 300 consisting of the set of templates 302-310 are fastened together to prevent loss. The curved handle portions 316 are each labeled with the type of eyebrow shape imprinted on the eyebrow template portion 314.

Each eyebrow template portion 314 has a particular eyebrow shape imprinted thereon such that when properly positioned, either the customer, looking in a mirror, or a beautician, can clearly visualize what the customer would look like with that particular shape eyebrow. Template 302 has, for an example, a slim high arch 320 imprinted on its front face beneath the straight upper edge 318. Template 304 has a medium arch 322 imprinted on its front face beneath its straight upper edge 318. Template 306 has a petite arch 324 imprinted on its front face beneath the straight upper edge 318. Template 308 has a high arch 326 imprinted on its front face beneath the straight upper edge 318. Template 310 has a full arch 328 imprinted on its front face beneath the straight upper edge 318. Since the templates are transparent, the imprinted eyebrow shape can be viewed either from the front side or from the back. Thus the templates are simply reversed in front of the customer's face for right or left eyebrow shape evaluation. Alternatively a pair of devices 300 may be utilized simultaneously by a user such as a beautician, to show a customer, via a mirror, what the customer would look like with both eyebrows shaped appropriately.

Figure 4:
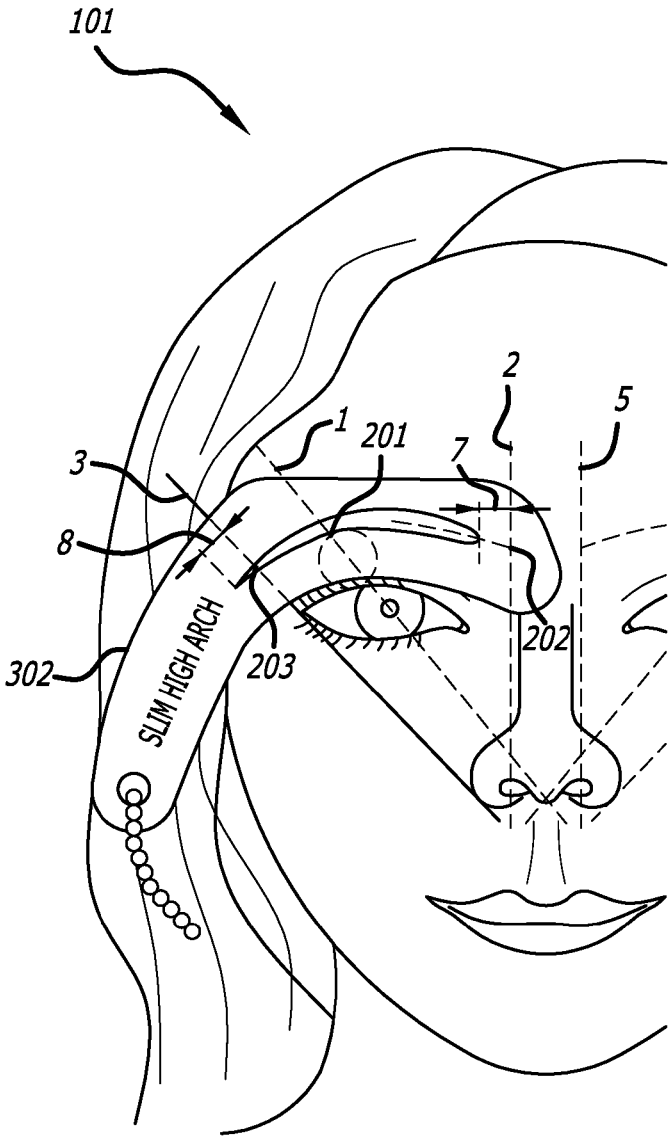
FIG. 4 is an illustration of one template of the device of FIGS. 2 and 3, superimposed on a partial-face frontal image of a person's face.

Referring now to FIG. 4, in one method, each eyebrow template is presented on an image 101 of a person's face, one by one, such that the concave underside of the high point of the eyebrow template aligns with the first point 201, which first point is determined as described above. As used herein, "high point", "starting point", and "ending point" when applied to an eyebrow template have the same meaning as above, only as applied to the eyebrow in the template. To select an appropriate eyebrow template, a first eyebrow template 302 is presented on the image 101. Then, a first offset 7 is determined, for example, by measuring on the image the distance from the second point 202 to the starting point of the eyebrow template. Then, a second offset 8 is determined, for example, by measuring on the image the distance from the third point 203 to the ending point of the eyebrow template. Thus, a total offset for template 302 can be determined by adding the first and second offsets 7, 8 together. A total offset for each of the other templates 304, 306, 308, 310 may be determined in a similar fashion. The eyebrow template having the smallest total offset may have the most pleasing shape for the person's face. Thus, the person's eyebrow may be shaped according to that eyebrow template.

Many changes may be made to the methods in accordance with the present disclosure. For example, each eyebrow template of a set of templates may be presented on the image of a person's face, one by one, such that the starting point of the eyebrow template aligns with the second point 202. To select an appropriate eyebrow template, a second offset is determined, for example, by measuring on the image the distance from the third point 203 to the ending point of the eyebrow template. Then a third offset may be determined by measuring on the image the distance from the first point 201 to the concave underside of the high point of the eyebrow template. A total offset can be determined for each eyebrow template by adding the second and third offsets together. The eyebrow may then be shaped according to the eyebrow template having the smallest total offset. Such changes and alternatives may be introduced without departing from the spirit and broad scope of my invention as defined by the claims below and their equivalents.

What is claimed is:

1. A method comprising:

providing a frontal image of a person's face, including a tip of the person's nose, nostrils, eyes including irises, supraorbital margins, and eyebrows;

determining a first guide line extending from the tip of the nose through an iris at the center of an eye;

locating a first point, wherein the first point is located on the first guide line one iris diameter upward from the intersection of an upper edge of the iris and the first guide line;

determining a second guide line extending vertically through the center of a respective nostril;

locating a second point at the intersection of a respective supraorbital margin and the second guide line;

determining a third guide line extending from the outer edge of the nostril through the outer edge of the eye;

locating a third point at the intersection of the supraorbital margin and the third guideline; and shaping an eyebrow such that:

a concave underside of a high point of the eyebrow is located at the first point;

a starting point of the eyebrow is located at the second point; and an ending point of the eyebrow is located at the third point.

2. The method of claim 1, wherein the shaping step comprises:

providing a plurality of eyebrow templates;

positioning, one by one, each eyebrow template of the plurality of eyebrow templates such that a concave underside of the high point of the eyebrow template aligns with the first point;

determining, for each eyebrow template, a first offset from a starting point of the eyebrow template to the second point, and a second offset from an ending point of the eyebrow template to the third point;

selecting one of the eyebrow templates having a smallest total offset; and shaping the eyebrow according to the selected template.

* * * * *